US006994758B2

(12) United States Patent
Robelet

(10) Patent No.: US 6,994,758 B2
(45) **Date of Patent: *Feb. 7, 2006**

(54) STEEL FOR MECHANICAL CONSTRUCTION, METHOD OF HOT-SHAPING OF A PART FROM THIS STEEL, AND PART THUS OBTAINED

(75) Inventor: Marc Robelet, Florange (FR)

(73) Assignee: Ascometal, Courbevoie (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/725,569

(22) Filed: Dec. 3, 2003

(65) Prior Publication Data

US 2004/0149361 A1 Aug. 5, 2004

(30) Foreign Application Priority Data

Dec. 5, 2002 (FR) ..... 02 15378

(51) Int. Cl.
*C21D 5/00* (2006.01)
*C21D 8/00* (2006.01)

(52) U.S. Cl. ..... 148/544; 148/545; 148/546; 148/547; 148/649

(58) Field of Classification Search ..... 148/544–547, 148/649

See application file for complete search history.

(56) References Cited

U.S. PATENT DOCUMENTS 5,667,605 A 9/1997 Bellus et al.
6,332,938 B1 12/2001 Sugawara

FOREIGN PATENT DOCUMENTS

DE 199 38 936 3/2000
EP 0 864 662 9/1998
GB 2 345 699 7/2000
JP 2001-123242 5/2001
JP 2002249823 * 9/2002
WO 98/03686 1/1998
WO 01/59170 8/2001

OTHER PUBLICATIONS

P. Kapranos et al., "Semi-solid processing of tool steel", Bulletin De L' Academie Nationale De Medecine, vol. 3, No. 7, part 2, pp. 835-840, Nov., 1993.

(Continued)

*Primary Examiner*—Sikyin Ip
(74) *Attorney, Agent, or Firm*—Wenderoth, Lind & Ponack, L.L.P.

(57) ABSTRACT

The invention relates to a steel for mechanical construction, wherein its composition in percentages by weight is: 0.35%≦C≦2.5%; 0.10%≦Mn≦2.5%; 0.60%≦Si≦3.0%; traces≦Cr≦4.5%; traces≦Mo≦2.0%; traces≦Ni≦4.5%; traces≦V≦0.5%; traces≦Cu≦4% with Cu≦Ni %+0.6 Si % if Cu≧0.5%; traces≦Al≦0.060%; traces≦Ca≦0.050%; traces≦B≦0.01%; traces≦S≦0.200%; traces≦Te≦0.020%; traces≦Se≦0.040%; traces≦Pb≦0.070%; traces≦Nb≦0.050%; traces≦Ti≦0.050%; the remainder being iron and impurities resulting from the manufacture.

The invention also relates to a method of hot-shaping a steel part, wherein a billet of steel of the preceding composition is obtained, it is heated to a temperature between the solidus and the liquidus so as to obtain a liquid phase and a globular solid phase, shaping of the said billet is carried out by thixoforging so as to obtain the said part, and cooling of the said part is carried out. Finally, the invention relates to a steel part thus obtained.

9 Claims, 2 Drawing Sheets

OTHER PUBLICATIONS

P. Kapranos, et al., "Semi-solid processing of aluminum and high melting point alloys", Proc. Instn. Mech. Engrs., vol. 207, No. B01, pp. 1-8, 1993.

Heike Meuser et al., "Microstructural investigations in the semi-solid state of the steel X210CrW12", Steel Research, vol. 27, No. 7, pp. 271-276, 2001.

* cited by examiner

STEEL FOR MECHANICAL CONSTRUCTION, METHOD OF HOT-SHAPING OF A PART FROM THIS STEEL, AND PART THUS OBTAINED

BACKGROUND OF THE INVENTION

The invention relates to the metallurgy of iron and steel, and more precisely to the manufacture of parts made from steel which can in particular be used in mechanical construction and shaped by the process known as "thixoforging".

Thixoforging belongs to the category of processes for shaping metals in the semi-solid state.

This process consists of producing a substantial deformation on a billet heated between the solidus and the liquidus. The steels used for this process are those which are conventionally used for hot-forging, and which are if necessary previously subjected to a metallurgical operation consisting of globulising the primary structure which is conventionally dendritic. In fact, this dendritic primary structure is not adapted to the thixoforging operations. In the course of heating up to temperatures between the solidus and the liquidus, the micro-segregation existing between the dendrites and the inter-dendritic spaces will bring about the fusion of the steel preferentially in these inter-dendritic spaces. During the operation of shaping this intergrowth of liquid and solid, the liquid phase will be ejected in a first stage at the start of the application of force. Therefore it is necessary to deform the solid phase and a residue of liquid for the most separated from the solid phase, which will result in an increase in the forces. For a deformation operation under these conditions the result obtained is poor: substantial segregation, internal defects.

On the other hand, when the thixoforging is carried out on a steel of globular structure brought to the semi-solid state by heating at a temperature between the liquidus and the solidus, the globular solid particles are distributed uniformly in the liquid phase. By optimising the choice of the solid/liquid proportions, it is possible to obtain a material having a raised rate of deformation under the effect of a considerable shear stress. It therefore has a very high deformability.

However, it is possible in certain cases to obtain the desired globular structure in the course of heating prior to the thixoforging, without having to carry out an operation of globulisation of the separated primary structure. This is the case in particular when operating on billets produced from rolled bars derived from continuous casting blooms or ingots. The multiple reheating and substantial deformations undergone by the steel have then led to a very imbricate and diffuse structure where a primary structure is practically impossible to show. It makes it possible to obtain a globular structure of the solid phase during the heating prior to thixoforging.

The thixoforging makes it possible, by comparison with conventional hot-forging processes, to produce in one single deformation operation parts of complex geometry which may have thin walls (1 mm or less) with very low shaping forces. In fact, under the action of external forces steels suitable for a thixoforging operation behave like viscous fluids.

For steels for mechanical construction, in which the carbon content can vary from 0.2% to 1.1%, the heating temperature necessary for the deformation by the thixoforging process is for example 1430° C.+50° C.=1480° C. (measured solidus temperature+50° C. to obtain the good ratio of liquid phase to solid phase necessary for the deformation) and 1315° C.+50° C.=1365° C. for a grade 100Cr6.

The heating temperature and the quantity of liquid phase formed are important parameters of the thixoforging process. The ease of obtaining the "good" temperature and the range of dispersion about this temperature so as to limit the variations of the quantity of liquid phase depend upon the solidification range. The greater this range is the easier it is to regulate the heating parameters.

For example, this solidification range is 110° C. for a grade C38 and 172° C. for the grade 100Cr6. Therefore it is much easier to work with this latter grade which has a low solidus temperature: 1315° C.

The very high shaping temperatures, the substantial rates of deformation which are used in the thixoforging process, lead to thermal stress on the deformation tools under conditions which are frequently extreme. This leads to the use for these tools of alloys with very high mechanical characteristics when hot or of ceramic materials. The difficulties of producing certain geometries or tools (inserts) of substantial volumes and the costs of producing them can slow down the development of the thixoforging process.

The object of the invention is to propose new grades of steel which are better adapted to thixoforging than those which are used conventionally in that they would make it possible to lower the shaping temperature and therefore to have less thermal stress on the deformation tools, and in that they would improve the behaviour of the steel during thixoforging. Moreover, these new grades should not degrade the mechanical properties of the parts obtained.

BRIEF SUMMARY OF THE INVENTION

To this end, the invention relates to a steel for mechanical construction, wherein its composition in percentages by weight is:

$0.35\% \leqq C \leqq 2.5\%$
$0.10\% \leqq Mn \leqq 2.5\%$
$0.60\% \leqq Si \leqq 3.0\%$
$\text{traces} \leqq Cr \leqq 4.5\%$
$\text{traces} \leqq Mo \leqq 2.0\%$
$\text{traces} \leqq Ni \leqq 4.5\%$
$\text{traces} \leqq V \leqq 0.5\%$
$\text{traces} \leqq Cu \leqq 4\%$ with $Cu \leqq Ni\ \% + 0.6\ Si\ \%$ if $Cu \geqq 0.5\%$
$\text{traces} \leqq Al \leqq 0.060\%$
$\text{traces} \leqq Ca \leqq 0.050\%$
$\text{traces} \leqq B \leqq 0.01\%$
$\text{traces} \leqq S \leqq 0.200\%$
$\text{traces} \leqq Te \leqq 0.020\%$
$\text{traces} \leqq Se \leqq 0.040\%$
$\text{traces} \leqq Pb \leqq 0.070\%$
$\text{traces} \leqq Nb \leqq 0.050\%$
$\text{traces} \leqq Ti \leqq 0.050\%$ the remainder being iron and impurities resulting from the manufacture.

The ratio Mn %/Si % is preferably greater than or equal to 0.4.

The steel may also contain $\text{traces} \leqq P \leqq 0.200\%$, $\text{traces} \leqq Bi \leqq 0.200\%$, $\text{traces} \leqq Sn \leqq 0.150\%$, $\text{traces} \leqq As \leqq 0.200\%$, $\text{traces} \leqq Sb \leqq 0.150\%$, with $P\ \% + Si\ \% + Sn\ \% + As\ \% + Sb\ \% \leqq 0.200\%$, The invention also relates to a method of hot-shaping a steel part, wherein:

a billet of steel of the preceding composition is obtained;

a heat treatment is if need be applied to it, which gives it a globular primary structure;

it is heated to an intermediate temperature between its solidus temperature and its liquidus temperature under conditions such that the solid fraction has a globular structure;

thixoforging of the said billet is carried out so as to obtain the said part;

and cooling of the said part is carried out.

The said thixoforging takes place preferably in a zone of temperatures where the liquid material fraction present in the billet is between 10 and 40%.

The said cooling is preferably carried out in still air, or at a speed lower than that which would obtain natural cooling in air.

As will be understood, the invention consists essentially of substantially increasing the silicon content of the grades of steel usually used to manufacture parts by thixoforging.

In fact, this addition of silicon makes it possible to lower the solidus temperature and, to a lesser extent, the liquidus temperature. Consequently the temperature at which the thixoforging of the steel can be carried out is reduced, with an equal liquid fraction.

Furthermore, the extent of the solidification range is increased, which tends towards greater ease of carrying out the thixoforging since the precision concerning the operating temperature becomes less critical. On the other hand, silicon has the property of improving the fluidity of the metal.

It is preferable to adhere to a ratio Mn %/Si % greater than or equal to 0.4. In fact, if the fluidity is raised because of a high silicon content (for example 1% or more), a manganese content which is too low gives the metal insufficient mechanical properties in the course of cooling during continuous casting, and hence a risk of the appearance of cracks. Such cracks can also appear for the same reasons during cooling following thixoforging, all the more so as the great variations in thickness of the part lead to significant disparities over the local cooling speeds. Thus stresses are created which are likely to favour the appearance of cracks if the mechanical properties of the steel are insufficient.

According to a variant of the invention, this addition of silicon is combined with an addition of other elements which, like silicon, can segregate at the grain boundaries: phosphorus, bismuth, tin, arsenic, antimony.

BRIEF DESCRIPTION OF THE SEVERAL VIEWS OF THE DRAWINGS

The invention will be better understood on reading the following description which is given with reference to the accompanying drawings in which.

DETAILED DESCRIPTION OF THE INVENTION

Figure 1:
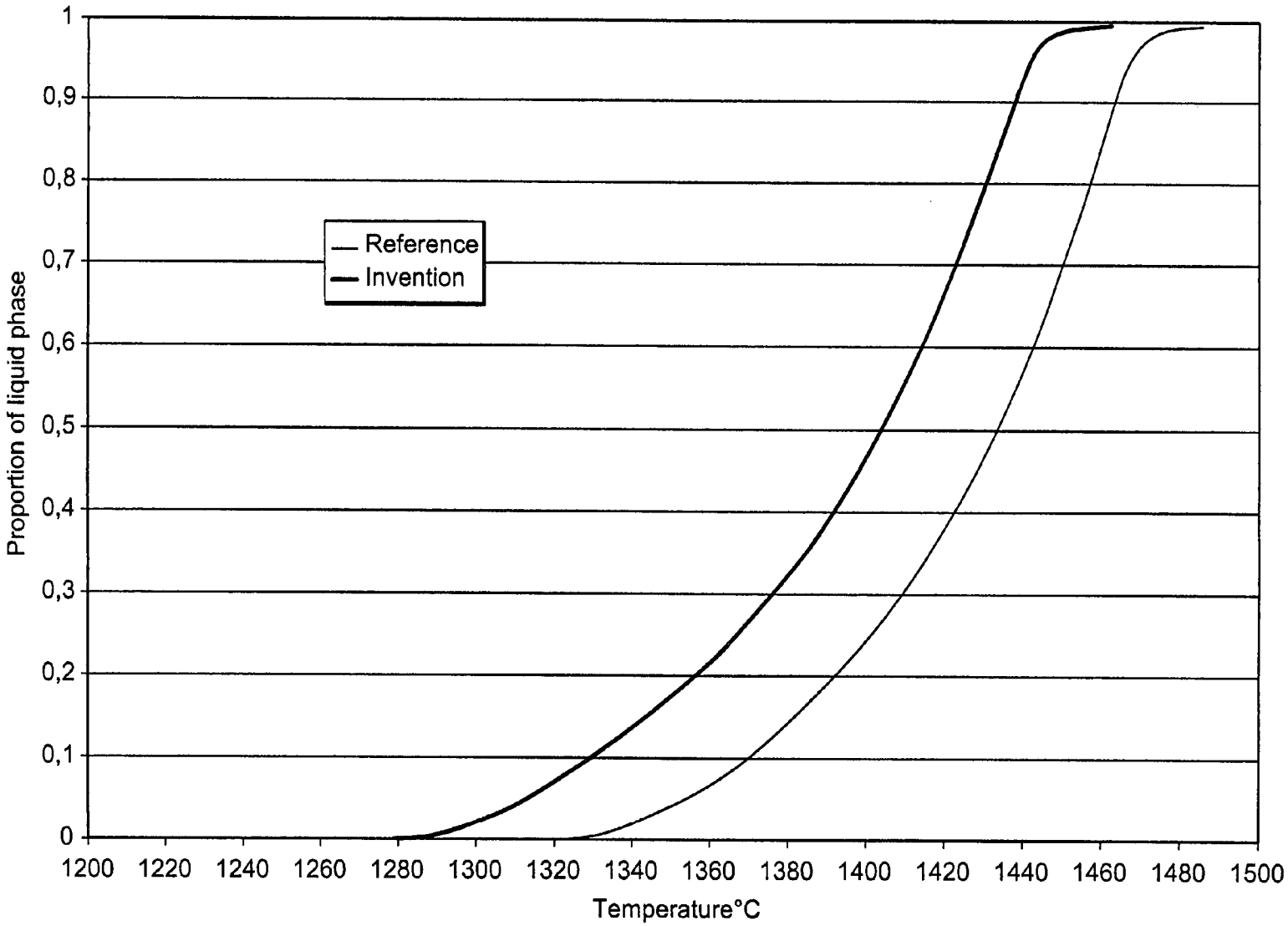
FIG. 1 shows the proportion of liquid phase as a function of the temperature in a first reference steel and in a first steel according to the invention which is derived therefrom.

In order to reduce the stresses on the tools during the thixoforging and to make this easier, the person skilled in the art has a first solution which consists, as has been said, of lowering the working temperatures by the addition of carbon. This solution makes it possible to lower the liquidus and solidus temperatures. However, it has the drawback that it has a substantial influence on the mechanical properties of the steel.

The inventors imagined that a beneficial effect on the stresses could be obtained by the addition of elements having a strong tendency to segregation at the grain boundaries: silicon, phosphorus, bismuth, tin, arsenic and antimony.

This strong segregation is not usually sought.

In fact, the fusion of such segregated zones at a temperature lower than the solidus, generally called the burning temperature, is prejudicial to the conventional hot-shaping operations: rolling and forging.

For a given forging or rolling temperature, lower than the solidus temperature for the matrix of the metal to be deformed, the presence of liquid zones due to elements which segregate at low fusion points, even with very small volumes (a few %) at the solid grain boundaries will lead to the disaggregation of the shaped material. This is the solid part which controls the deformation mechanisms for these shaping methods, and the forces necessary for shaping lead to (total or partial) ruptures of material which are prejudicial to the production of the product and to its properties. In the case where the liquid phase is greater than 10%, which is the case in thixoforging, the material is two-phase, which results in very different behaviour during the deformation: the solid particles are included in liquid and if there are contacts (called bridges) between the solid particles the very weak forces necessary to rupture them do not cause ruining of the material.

In the case of thixoforging where the burning temperature is greatly exceeded, the fusion of the segregated zones creates liquid pockets which favour and accelerate the formation of liquid phase within the steel. Therefore there is an interest in promoting this.

Thus by virtue of the invention it is possible to obtain the quantity of liquid phase necessary for the thixoforging to proceed well at a temperature lower than that usually necessary when the process does not go on to the addition of at least one of the elements referred to previously, and particularly silicon.

The carbon content of the steels according to the invention can vary between 0.35% and 2.5%. Under these conditions it is possible to obtain metallic structures, mechanical properties and wear properties which are desirable for thixoforged steel parts which can be used in mechanical construction. The carbon content must be chosen as a function of the use envisaged.

The silicon content of the steels according to the invention can vary between 0.60 and 3%. Like carbon, silicon makes it possible to lower the solidus and liquidus temperatures and to widen the solidification range. It also has a synergetic effect on the segregation of the other elements. Equally it makes it possible to improve the fluidity of the metal. For the reasons stated it is preferable for the ratio Mn %/Si % to be greater than or equal to 0.4

The manganese content can be between 0.10 and 2.5%. It must be adjusted as a function of the mechanical properties required, in conjunction with the carbon and silicon contents. It has relatively little influence on the liquidus and solidus temperatures. Obtaining an optimum ratio Mn %/Si % can lead to having to increase the manganese content substantially together with the silicon content relative to the reference steels, all other things being equal.

The chromium content may be between traces and 4.5%.

The molybdenum content may be between traces and 4.5%.

The nickel content may be between traces and 4.5%.

The adjustment of the chromium, molybdenum and nickel contents makes it possible to ensure the mechanical properties of the parts produced: resistance to rupture, yield strength and resilience.

The vanadium content is between traces and 0.5%. For certain applications where the resilience is not important, this element makes it possible to obtain steels with very high mechanical characteristics which can be substituted for steels rich in chromium and/or molybdenum and/or nickel, which are more expensive.

The copper content may be between traces and 4.0%. This element makes it possible to increase the mechanical characteristics, to improve the corrosion resistance and to lower the solidus temperature. It should be noted that if copper is present in high quantities (0.5% and more) it is necessary for nickel and/or silicon to be present in sufficient quantities to avoid problems on hot-rolling or forging. It is considered that if Cu %≧0.5% it is necessary for Cu≦Ni %+0.6 Si %.

The contents of aluminium and calcium, deoxidising elements, are between traces and respectively 0.060% for aluminium and 0.050% for calcium.

The content of boron, a hardening element, is between traces and 0.010%.

The sulphur content is between traces and 0.200%. A high content favours the machinability of the metal, particularly if it has added to it elements such as tellurium (up to 0.020%), selenium (up to 0.040%) and lead (up to 0.070%). These elements for machinability have only a little influence on the solidus and liquidus temperatures. When sulphur is added in significant quantities, it is good to have a ratio Mn %/S % of at least 4 so that the hot-rolling is carried out without the formation of defects.

Niobium and titanium, when they are added, make it possible to control the grain size. Their maximum admissible contents are 0.050%.

With regard to the segregating elements other than silicon, the presence of which may be recommended, these elements can be present alone or in combination. If they are alone (that is to say that the other elements in the list are only present as traces), so that a significant effect is obtained, then there must be at least 0.050% of phosphorus, or 0.050% of bismuth, or 0.050% of tin, or 0.050% of arsenic or 0.050% of antimony.

The sum of the elements phosphorus, bismuth, tin, arsenic and antimony must preferably be greater than 0.050% and must not exceed 0.200% so as to avoid the problems mentioned above during hot-rolling or forging, enabling the billet to be obtained which is intended to undergo thixoforging.

Naturally, in the case of addition of arsenic during the production of the liquid metal, all the necessary precautions must be taken so that the toxic vapours released are collected in such a manner that they do not poison the staff at the steelworks. In fact the presence of arsenic most frequently results from the addition of copper or tin which arsenic generally accompanies by way of an impurity. As arsenic is an element which is very highly segregating, it is necessary to take it into account to be sure that in combination with the other segregating elements it does not lead to effects which are prejudicial to the hot transformation which have been cited.

Table 1 sets out the compositions of a first pair formed by a reference steel and a steel according to the invention which is derived therefrom.

TABLE 1

| | Composition of a reference steel and a steel according to the invention (in % by weight) | | | | | | | | | | |
|---|---|---|---|---|---|---|---|---|---|---|---|
| | C | Mn | Si | Cr | Mo | Ni | Cu | S | P | Ti | Al |
| reference | 0.962 | 0.341 | 0.237 | 1.5 | 0.017 | 0.089 | 0.161 | 0.01 | 0.009 | 0.002 | 0.037 |
| invention | 1.111 | 1.005 | 1.53 | 1.44 | 0.003 | 0.164 | 0.137 | 0.008 | 0.003 | 0.0027 | 0.039 |

Relative to the reference steel, it will be seen that apart from the very significant addition of silicon, the manganese content has been substantially increased so as to re-establish a ratio Mn %/Si % in accordance with the preferred requirements of the invention.

FIG. 1 represents the proportion of liquid phase as a function of the temperature in these two steels.

The measured solidus temperatures are 1315° C. for the reference steel and 1278° C. for the steel according to the invention.

The measured liquidus temperatures are respectively 1487° C. and 1460° C. The solidification ranges for these two steels have respective widths of 172° C. and 182° C. On the other hand, the temperature range in which the liquid fraction of the steel is included between 10 and 40%, and which is usually considered the most favourable for thixoforging, is:

for the reference steel, from 1370 to 1422° C.;

for the steel according to the invention, from 1382 to 1388° C.

Therefore a lowering of this range of the order of 30 to 40° C. and a widening of its extent by 8° C. is observed, all things which lead in the direction of less stress on the tools during thixoforging and greater ease of obtaining conditions favourable to good progress of the operation. This effect would be enhanced if other segregating elements than silicon were also added within the limits which have been stated.

Table 2 sets out the compositions of a second pair formed by a reference steel and another steel according to the invention which is derived therefrom.

TABLE 2

| | Composition of a reference steel and of a steel according to the invention (in % by weight) | | | | | | | | | |
|---|---|---|---|---|---|---|---|---|---|---|
| | C | Mn | Si | Cr | Mo | Ni | Cu | P | S | Al |
| reference | 0.377 | 0.825 | 0.19 | 0.167 | 0.039 | 0.113 | 0.143 | 0.007 | 0.009 | 0.022 |
| invention | 0.385 | 1.385 | 0.65 | 0.193 | 0.029 | 0.087 | 0.110 | 0.008 | 0.051 | 0.025 |

Relative to the reference steel, there again the manganese content has been increased in the steel according to the invention and for the same reasons as in the preceding example, but in lesser proportions since the silicon content of this steel is at the bottom of the range demanded by the invention.

Figure 2:
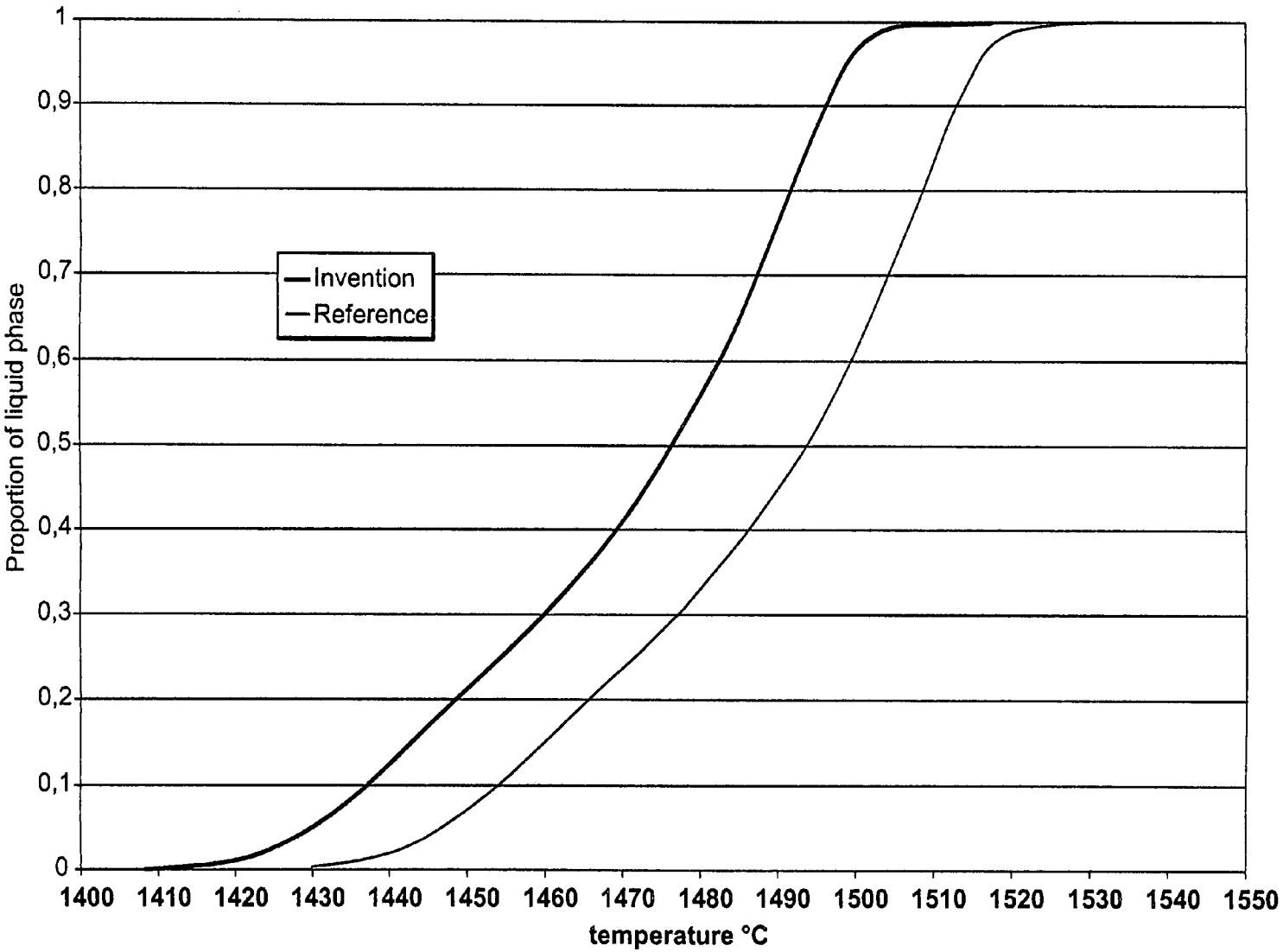
FIG. 2 shows the proportion of liquid phase as a function of the temperature in a second reference steel and in a second steel according to the invention which is derived therefrom.

FIG. 2 shows the proportion of liquid phase as a function of the temperature in these steels.

The measured solidus temperature is 1430° C. and 1415° C. for the steel according to the invention. The measured liquidus temperatures are respectively 1528° C. and 1515° C. The solidification ranges for these two steels therefore have respective widths of 98° C. and 100° C. On the other hand, the temperature range in which the liquid fraction of the steel is included between 10 and 40% is:

for the reference steel, from 1470° C. to 1494° C., for the steel according to the invention, from 1437° C. to 1469° C.

The lowering of this range is of the order of 30° C. and its extent is widened by 8° C., which is favourable to less stress on the tools during thixoforging. There again, this effect could be accentuated (particularly by a widening of this range) with a further addition of segregating elements other than silicon.

With regard to the determination of the solidus and liquidus temperatures to be taken into account for carrying out the invention, it should be noted that they cannot always coincide with those which are calculated on the basis of the composition of the steel with the aid of formulae conventionally available in the literature. In fact, these formulae are valuable in the case of passage from liquid steel to solid steel during solidification and cooling of the steel and for cooling rates of several degrees per minute.

In the case of measurements carried out with a view to application to thixoforging, the measurements must be carried out by starting from the solid steel and progressing towards the liquid steel, that is to say in the case of heating then of fusion of the steel. The tests are also carried out with conditions of increasing the temperature of the order of several tens of degrees per minute, corresponding to the conditions of heating prior to the thixoforging operation.

The thixoforging operation carried out on steels according to the invention must be preceded by heat treatment for globulisation of the primary structure of the billet if a globular structure is not already present or if it cannot be obtained during heating to bring the part which is to undergo thixoforging to a suitable temperature. As has been said, the necessity or otherwise of proceeding with such prior heat treatment depends in particular upon the history of the billet and in particular the deformations and heat treatments which it has undergone.

Obtaining such a globular structure before thixoforging for a steel of given composition and history may be verified if the billet is cooled suddenly before proceeding to thixoforging it. The structure is then observed as it was before the cooling.

With regard to the cooling of the part following thixoforging, this cooling must be carried out in still air and not in a forced manner in the case (frequent for this type of part) where the part has very substantial variations in cross-section, for example thin walls (1 to 2 mm) are connected to thick zones 5 to 10 mm or more). The use of blown air is prohibited in this case because then there is a risk of introducing very substantial residual stresses between thin walls and thick zones. This would result in surface defects degrading the properties of the thixoforged part.

In certain cases it may be necessary to slow down the cooling of the parts so as to favour the structural homogeneity of the different parts thereof. For this purpose the part can be passed into a tunnel regulated in temperature within the range 200–700° C. for example.

However, it the thixoforged part does not exhibit such substantial variations in cross-section it may be tolerable to effect cooling in blown air. Such cooling may favour obtaining a homogeneous metallurgical structure in the cross-section of the part and good mechanical characteristics.

The invention claimed is:

1. A method of hot-shaping a steel part, which comprises obtaining a billet of steel with the following composition:

$0.35\% \leqq C \leqq 2.5\%$ $0.10\% \leqq Mn \leqq 2.5\%$ $0.60\% \leqq Si \leqq 3.0\%$ traces $\leqq Cr \leqq 4.5\%$ traces $\leqq Mo \leqq 2.0\%$ traces $\leqq Ni \leqq 4.5\%$ traces $\leqq V \leqq 0.5\%$ traces $\leqq Cu \leqq 4\%$ with $Cu \leqq Ni\ \% + 0.6\ Si\ \%$ if $Cu \geqq 0.5\%$ traces $\leqq Al \leqq 0.060\%$ traces $\leqq Ca \leqq 0.050\%$ traces $\leqq B \leqq 0.01\%$ traces $\leqq S \leqq 0.200\%$ traces $\leqq Te \leqq 0.020\%$ traces $\leqq Se \leqq 0.040\%$ traces $\leqq Pb \leqq 0.070\%$ traces $\leqq Nb \leqq 0.050\%$ traces $\leqq Ti \leqq 0.050\%$ optionally: traces $\leqq P\ \% \leqq 0.200\%$, traces $\leqq Bi \leqq 0.200\%$, traces $\leqq Sn \leqq 0.200\%$, traces $\leqq As \leqq 0.200\%$, traces $\leqq Sb \leqq 0.200\%$, with $P\ \% + Bi\ \% + Sn\ \% + As\ \% + Sb\ \% \leqq 0.200\%$, the remainder being iron and impurities resulting from the manufacture;

heating the billet to an intermediate temperature between its solidus temperature and its liguidus temperature under conditions such that the solid fraction of the billet has a globular structure;

thixoforging the billet so as to obtain the said part;

and cooling the said part.

2. The method according to claim 1, wherein the said thixoforging takes place in a zone of temperatures where the liquid material fraction present in the billet is between 10 and 40%.

3. The method according to claim 1, wherein the said cooling is effected in still air.

4. The method according to claim 2, wherein the said cooling is effected in still air.

5. The method according to claim 3, wherein the said cooling is carried out at a speed lower than that which would obtain natural cooling in air.

6. The method according to claim 4, wherein the said cooling is carried out at a speed lower than that which would obtain natural cooling in air.

7. A steel part obtained by a hot-shaping method as claimed in claim 1.

8. The method according to claim 1, wherein the Mn and Si contents of the billet satisfy the relationship Mn %/Si %$\geqq$0.4.

9. The method according to claim 1, which further comprises heat treating the billet to give the billet a globular primary structure, before heating the billet to the intermediate temperature.

* * * * *